US011561035B2

(12) United States Patent
Cao

(10) Patent No.: US 11,561,035 B2
(45) Date of Patent: Jan. 24, 2023

(54) METHOD FOR SUPPRESSING THE BLOCKAGE OF MINIATURE JOULE-THOMSON CRYOCOOLER BASED ON PHOTOTHERMAL EFFECT

(71) Applicant: Tsinghua University, Beijing (CN)

(72) Inventor: Haishan Cao, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 125 days.

(21) Appl. No.: 17/344,448

(22) Filed: Jun. 10, 2021

(65) Prior Publication Data

US 2021/0389033 A1 Dec. 16, 2021

(30) Foreign Application Priority Data

Jun. 12, 2020 (CN) ..... 202010540396.4

(51) Int. Cl.
*F25B 45/00* (2006.01)
*F25B 49/02* (2006.01)

(52) U.S. Cl.
CPC ..... *F25B 45/00* (2013.01); *F25B 49/02* (2013.01); *F25B 2309/02* (2013.01); *F25B 2500/04* (2013.01)

(58) Field of Classification Search
CPC ..... F25B 45/00; F25B 49/02; F25B 49/005; F25B 2309/02; F25B 2500/04; F25B 2347/02; F25B 47/02; F25B 47/006; F25B 47/00
See application file for complete search history.

*Primary Examiner* — Emmanuel E Duke
(74) *Attorney, Agent, or Firm* — Hodgson Russ LLP

(57) ABSTRACT

A method for suppressing the blockage of a miniature Joule-Thomson cryocooler based on a photothermal effect includes: determining form and temperature of a trace impurity contained in a working medium of the cryocooler according to an operating condition of the cryocooler, and selecting an optimal wavelength of an electromagnetic wave based on the form and temperature of the impurity and a peak of absorption spectrum of the impurity to electromagnetic waves; estimating, via a prediction model of input power of the electromagnetic wave, an initial value of input power corresponding to the optimal wavelength; and emitting an electromagnetic wave with the power W by a laser capable of generating the optimal wavelength in a direction perpendicular to a passage of a throttle in the cryocooler to eliminate the impurity in the passage of the throttle.

9 Claims, 2 Drawing Sheets

METHOD FOR SUPPRESSING THE BLOCKAGE OF MINIATURE JOULE-THOMSON CRYOCOOLER BASED ON PHOTOTHERMAL EFFECT

CROSS-REFERENCE TO RELATED APPLICATION

This application claims priority to and benefits of Chinese Patent Application Serial No. 202010540396.4, filed with the National Intellectual Property Administration of PRC on Jun. 12, 2020, the entire content of which is incorporated herein by reference.

FIELD

The present disclosure relates to the field of miniature Joule-Thomson cryocoolers, and more particularly to a method, system and device for suppressing the blockage of a miniature Joule-Thomson cryocooler based on a photothermal effect.

BACKGROUND

Miniature cryogenic refrigeration technology plays an increasingly prominent role in many important fields like national defense and military, scientific research, electronic communications and biomedicine. For example, infrared detectors in missile tracking equipment, low-noise amplifiers in radio telescopes, superconducting filters in mobile communication systems and superconductor quantum interferometers in biomagnetic signal detectors all need to operate in a low temperature environment. Such low-temperature electronic devices release only a small amount of heat during operation, generally in the range of a few milliwatts to a few hundred milliwatts. Therefore, in order to effectively cool such low-temperature electronic devices, it is necessary to develop a miniature cryogenic cryocooler that matches the low-temperature electronic devices in size and cooling capacity. Miniature Joule-Thomson cryocoolers based on micro electromechanical system (MEMS) technology were born under this application background, and have attracted more and more attention in the field of miniature cryogenic refrigeration due to their compact structure, no vibration, no electromagnetic interference, and perfect coupling with electronic devices to be cooled. MEMS technology has opened up a new direction for the miniaturization of cryocoolers, but the wide application of the miniature Joule-Thomson cryocoolers based on the MEMS technology still faces many challenges, one of which is the blockage of the miniature Joule-Thomson cryocooler in long-term operation caused by the condensation and deposition of trace impurities contained in the working medium of the cryocooler, which limits the application field of the miniature Joule-Thomson cryocooler, and thus is a key issue to be solved in the field of miniature cryogenic refrigeration.

For instance, the research found that the blockage of the miniature Joule-Thomson cryocooler with a cooling temperature above the liquid nitrogen temperature range is mainly caused by trace water in the working medium. Although most of the water in the working medium can be removed by a filter, the trace water (in the ppb-ppm level) remaining in the working medium will still cause the blockage of the miniature Joule-Thomson cryocooler, thereby affecting the performance of the cryocooler. Previous studies suggested that the trace water in the working medium first condenses and deposits into ice crystals in a heat exchanger of the cryocooler, and then the ice crystals are separated from an inner wall of the heat exchanger under the flow impact of the working medium and enter into the throttle with the working medium to cause the blockage of the throttle. Based on this blocking mechanism, researchers tried to extend the continuous operation time of the cryocooler by arranging an ice crystal filter layer in the heat exchanger (Lerou, P., 2012. Micro-cooling device. European Patent, EP2444769A1). However, with the help of microscopic observations in combination with theoretical analysis, the applicant revealed that the blockage of the miniature throttle cryocooler is caused by the direct deposition of the trace water in the throttle (Cao, H. S., Vanapalli, S., Holland, H. J., Vermeer, C. H., ter Brake, H. J. M, 2013. Clogging in micromachined Joule-Thomson coolers: Mechanism and preventive measures. Applied Physics Letters 103, 034107). Therefore, arranging an ice crystal filter layer in the heat exchanger cannot prevent the direct deposition of the impurity water molecules in the throttle. At present, the main way to solve the blockage is to heat the whole cold end of the cryocooler to sublimate and remove the ice, so as to restore the channel size of the throttle and the mass flow rate of the miniature Joule-Thomson cryocooler. However, this solution cannot meet the requirements of continuous low-temperature operation of the miniature Joule-Thomson cryocooler.

SUMMARY

Embodiments of the present disclosure seek to solve at least one of the problems existing in the related art to at least some extent.

Embodiments of the present disclosure aim at providing a method, system and device for suppressing the blockage of a miniature Joule-Thomson cryocooler by selectively heating and removing ice, rather than heating the whole cold end of the cryocooler. According to embodiments of the present disclosure, by taking advantage of the difference between the material (such as glass, silicon, etc.) of the miniature Joule-Thomson cryocooler and the ice in the absorptivity to electromagnetic waves in near/mid-infrared bands, the ice in the throttle can be heated and removed via a photothermal effect of electromagnetic waves of specific wavelengths in this band, instead of heating the whole cold end of the miniature Joule-Thomson cryocooler, while maintaining the continuous low-temperature operation of the miniature Joule-Thomson cryocooler.

In a first aspect of embodiments of the present disclosure, a method for suppressing the blockage of a miniature Joule-Thomson cryocooler based on a photothermal effect is provided. The method includes:

1) determining form and temperature of a trace impurity contained in a working medium of the cryocooler according to an operating condition of the cryocooler, and selecting an optimal wavelength of an electromagnetic wave based on the form and temperature of the impurity and a peak of absorption spectrum of the impurity to electromagnetic waves;

2) estimating, via a prediction model of input power of the electromagnetic wave, an initial value of input power corresponding to the optimal wavelength determined by step 1), which comprises:

2-1) estimating a deposition rate of the trace impurity contained in the working medium of the cryocooler in accordance with formula (1) based on pressure of the working medium in the cryocooler, a content of the trace impurity in the working medium and a cooling temperature of the cryocooler:

$$\dot{n}_{dep} = (p - p_{sat}) / \left( \frac{0.5hRT}{D_{12}} + \frac{\sqrt{2\pi MRT}}{\alpha} \right) \quad (1)$$

where $\dot{n}_{dep}$ represents a deposition rate, p represents average partial pressure of the trace impurity in the working medium, $p_{sat}$ represents saturated vapor pressure of impurity at the cooling temperature, h represents a height of a microchannel in the cryocooler, R represents an ideal gas constant, $D_{12}$ represents a diffusion coefficient of impurity molecules in the working medium, M represents a molar mass of the impurity molecule, and α represents a thermal accommodation coefficient;

2-2) estimating heat flux required by sublimation of the impurity in accordance with formula (2) based on the deposition rate of the trace impurity and sublimation latent heat of the impurity:

$$\dot{Q} = \dot{n}_{dep} \Delta H_{imp} \quad (2)$$

where $\dot{Q}$ represents the heat flux, and $\Delta H_{imp}$ represents the sublimation latent heat of the impurity; and 2-3) estimating the input power corresponding to the optimal wavelength determined by step 1) in accordance with formula (3) based on the estimated heat flux $\dot{Q}$ required by the sublimation of the impurity, an area of a passage of a throttle in the cryocooler and a transmissivity of a material of the cryocooler to the electromagnetic wave:

$$W = \dot{Q}A/\tau \quad (3)$$

where W represents the input power, A represents the area of the passage of the throttle in the cryocooler, and τ represents the transmissivity; and 3) emitting an electromagnetic wave with the power W by a laser capable of generating the optimal wavelength in a direction perpendicular to the passage of the throttle in the cryocooler to eliminate the impurity in the passage of the throttle.

In some embodiments, the trace impurity contained in the working medium of the cryocooler is trace water contained in the working medium, and the method includes:

1) determining form and temperature of ice according to an operating condition of the miniature Joule-Thomson cryocooler, and selecting an optimal wavelength of an electromagnetic wave based on the form and temperature of the ice and a peak of absorption spectrum of the ice to electromagnetic waves;

2) estimating, via a prediction model of input power of the electromagnetic wave, an initial value of input power corresponding to the optimal wavelength determined by step 1), which includes:

2-1) estimating an ice formation rate of trace water contained in a working medium of the cryocooler in accordance with formula (1) based on pressure of the working medium in the cryocooler, a content of the trace water in the working medium and a cooling temperature of the cryocooler:

$$\dot{n}_{dep} = (p - p_{sat}) / \left( \frac{0.5hRT}{D_{12}} + \frac{\sqrt{2\pi MRT}}{\alpha} \right) \quad (1)$$

where $\dot{n}_{dep}$ represents a deposition rate, p represents average partial pressure of the trace water in the working medium, $p_{sat}$ represents saturated vapor pressure of steam at the cooling temperature, h represents a height of a microchannel in the cryocooler, R represents an ideal gas constant, $D_{12}$ represents a diffusion coefficient of water molecules in the working medium, M represents a molar mass of the water molecule, and α represents a thermal accommodation coefficient;

2-2) estimating heat flux required by sublimation of the ice in accordance with formula (2.1) based on the ice formation rate of the trace water and sublimation latent heat of the ice:

$$\dot{Q} = \dot{n}_{dep} \Delta H_{ice} \quad (2.1)$$

where $\dot{Q}$ represents the heat flux, and $\Delta H_{ice}$ represents the sublimation latent heat of the ice; and 2-3) estimating the input power corresponding to the optimal wavelength determined by step 1) in accordance with formula (3) based on the estimated heat flux $\dot{Q}$ required by the sublimation of the ice, an area of a passage of a throttle in the cryocooler and a transmissivity of a material of the cryocooler to the electromagnetic wave:

$$W = \dot{Q}A/\tau \quad (3)$$

where W represents the input power, A represents the area of the passage of the throttle in the cryocooler, and r represents the transmissivity; and 3) emitting an electromagnetic wave with the power W by a laser capable of generating the optimal wavelength in a direction perpendicular to the passage of the throttle in the cryocooler to eliminate the ice in the passage of the throttle.

In some embodiments of the present disclosure, the method further includes:

monitoring a variation of mass flow rate in the cryocooler;

increasing, if the mass flow rate in the cryocooler is unstable, the power of the electromagnetic wave until the mass flow rate in the cryocooler is stable;

determining whether the estimated input power is minimum, if no, decreasing the power of the electromagnetic wave until the mass flow rate in the cryocooler is kept stable at a minimum power so as to determine the minimum power $W_{min}$ of the electromagnetic wave corresponding to the optimal wavelength needed for eliminating the impurity in the passage of the throttle in the cryocooler; and emitting an electromagnetic wave with the minimum power $W_{min}$ by the laser capable of generating the optimal wavelength in the direction perpendicular to the passage of the throttle in the cryocooler.

In a second aspect of embodiments of the present disclosure, there is provided a system for suppressing the blockage of a miniature Joule-Thomson cryocooler based on a photothermal effect. The system includes: a miniature Joule-Thomson cryocooler which includes a throttle; a vacuum chamber configured to accommodating the miniature Joule-Thomson cryocooler; and a laser, having an emitting end accommodated in the vacuum chamber and configured to emit, in a direction perpendicular to a passage of the throttle, an electromagnetic wave with an optimal wavelength and a minimum power determined by the method as described in embodiments of the first aspect to eliminate trace impurity deposited in the passage of the throttle.

In a third aspect of embodiments of the present disclosure, there is provided a device for suppressing the blockage of a miniature Joule-Thomson cryocooler based on a photothermal effect. The device includes: a processor; a memory having stored therein a computer program that, when executed by the processor, causes the processor to perform the method as described in embodiments of the first aspect.

It should be appreciated that, the general description hereinbefore and the detail description hereinafter are explanatory and illustrative, and shall not be construed to limit the present disclosure.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

Figure 1:
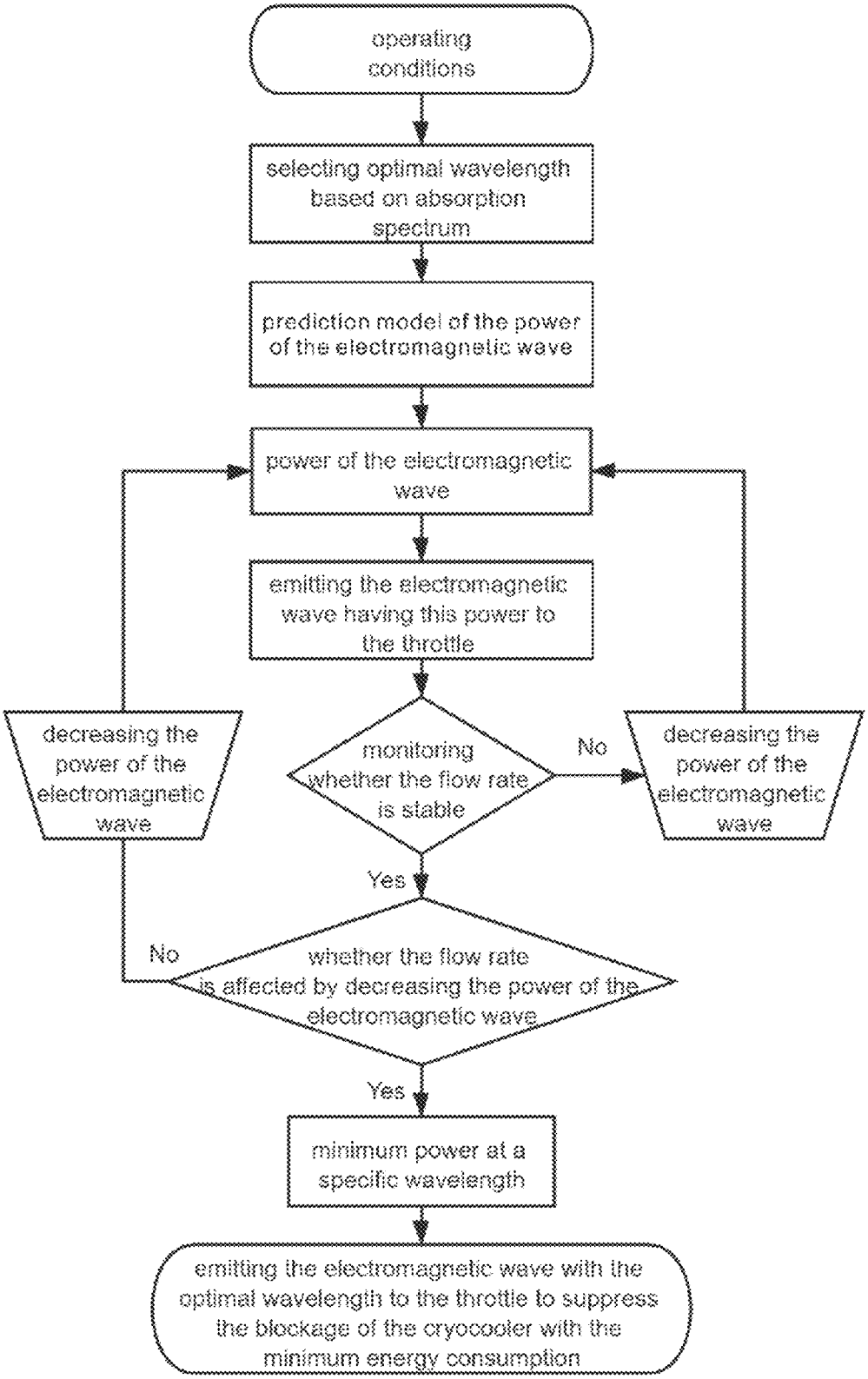
FIG. 1 is a flow chart of a method for suppressing the blockage of a miniature Joule-Thomson cryocooler based on a photothermal effect according to some embodiments of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

For better understanding of the present disclosure, description will be made in detail for a method, system and device for suppressing the blockage of a miniature Joule-Thomson cryocooler based on a photothermal effect and their application examples.

The present disclosure provides in some embodiments a method for suppressing the blockage of a miniature Joule-Thomson cryocooler based on a photothermal effect is provided. The method includes:

1) determining form and temperature of a trace impurity contained in a working medium of the cryocooler according to an operating condition of the cryocooler, and selecting an optimal wavelength of an electromagnetic wave based on the form and temperature of the impurity and a peak of absorption spectrum of the impurity to electromagnetic waves;

2) estimating, via a prediction model of input power of the electromagnetic wave, an initial value of input power corresponding to the optimal wavelength determined by step 1), which comprises:

2-1) estimating a deposition rate of the trace impurity contained in the working medium of the cryocooler in accordance with formula (1) based on pressure of the working medium in the cryocooler, a content of the trace impurity in the working medium and a cooling temperature of the cryocooler:

$$\dot{n}_{dep} = (p - p_{sat})/\left(\frac{0.5hRT}{D_{12}} + \frac{\sqrt{2\pi MRT}}{\alpha}\right) \quad (1)$$

where $\dot{n}_{dep}$ represents a deposition rate, p represents average partial pressure of the trace impurity in the working medium, $p_{sat}$ represents saturated vapor pressure of impurity at the cooling temperature, h represents a height of a microchannel in the cryocooler, R represents an ideal gas constant, $D_{12}$ represents a diffusion coefficient of impurity molecules in the working medium, M represents a molar mass of the impurity molecule, and α represents a thermal accommodation coefficient;

2-2) estimating heat flux required by sublimation of the impurity in accordance with formula (2) based on the deposition rate of the trace impurity and sublimation latent heat of the impurity:

$$\dot{Q} = \dot{n}_{dep}\Delta H_{imp} \quad (2)$$

where $\dot{Q}$ represents the heat flux, and $\Delta H_{imp}$ represents the sublimation latent heat of the impurity; and 2-3) estimating the input power corresponding to the optimal wavelength determined by step 1) in accordance with formula (3) based on the estimated heat flux $\dot{Q}$ required by the sublimation of the impurity, an area of a passage of a throttle in the cryocooler and a transmissivity of a material of the cryocooler to the electromagnetic wave:

$$W = \dot{Q}A/\tau \quad (3)$$

where W represents the input power, A represents the area of the passage of the throttle in the cryocooler, and τ represents the transmissivity; and 3) emitting an electromagnetic wave with the power W by a laser capable of generating the optimal wavelength in a direction perpendicular to the passage of the throttle in the cryocooler to eliminate the impurity in the passage of the throttle.

In some embodiments, the trace impurity contained in the working medium of the cryocooler is trace water contained in the working medium.

In the following, the method according to embodiments of the present disclosure will be detailed by taking the trace water as an example of the trace impurity contained in the working medium of the cryocooler.

As illustrated in FIG. 1, the method for suppressing the blockage of a miniature Joule-Thomson cryocooler based on a photothermal effect includes the following steps.

Figure 2:
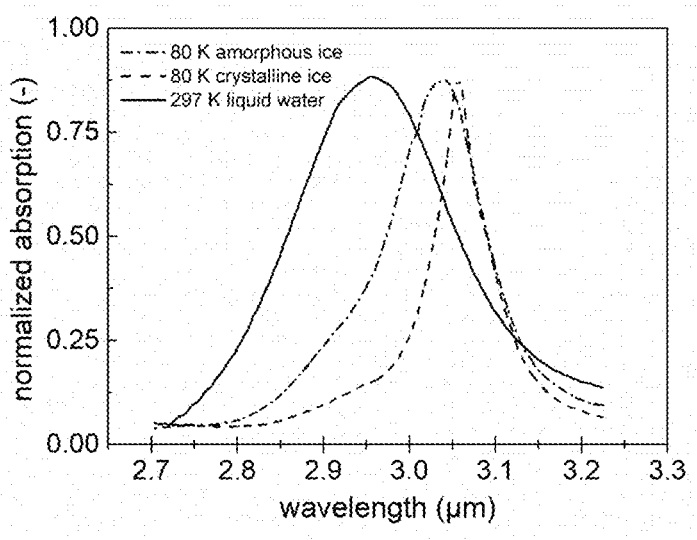
FIG. 2 is a normalized absorption spectrum of water in different morphologies, including 297 K liquid water (shown in a dotted line), 80 K crystalline ice (shown in a dot dash line) and 80 K amorphous ice (shown in a solid line).

In step 1), form and temperature of ice is determined according to an operating condition of the miniature Joule-Thomson cryocooler (including pressure of a working medium in the cryocooler, a content of trace water in the working medium and a cooling temperature of the cryocooler), and an optimal wavelength of an electromagnetic wave is selected based on the form and temperature of the ice and a peak of absorption spectrum of the ice to electromagnetic waves. For example, the optimal wavelength of the electromagnetic wave absorbed by 80 K crystalline ice is 3.06 μm, and the optimal wavelength of the electromagnetic wave absorbed by 80 K amorphous ice is 3.04 μm, as shown in FIG. 2.

In step 2), an initial value of input power of the electromagnetic wave corresponding to the optimal wavelength determined by step 1) is estimated via a prediction model of input power of the electromagnetic wave. Specifically, the step 2 includes the following steps 2-1) to 2-3).

In step 2-1), an ice formation rate of trace water contained in the working medium of the cryocooler is estimated in accordance with formula (1) based on the pressure of the working medium in the cryocooler, the content of the trace water in the working medium and the cooling temperature of the cryocooler:

$$\dot{n}_{dep} = (p - p_{sat}) / \left( \frac{0.5hRT}{D_{12}} + \frac{\sqrt{2\pi MRT}}{\alpha} \right) \quad (1)$$

where $\dot{n}_{dep}$ represents a deposition rate ($mol \cdot m^{-2} \cdot s^{-1}$), p represents average partial pressure (Pa) of the trace water in the working medium, $p_{sat}$ represents saturated vapor pressure of steam at the cooling temperature (T), h represents a height (m) of a microchannel in the cryocooler, R represents an ideal gas constant ($J \cdot K^{-1} \cdot mol^{-1}$), $D_{12}$ represents a diffusion coefficient ($m^2 \cdot s^{-1}$) of water molecules in the working medium, M represents a molar mass (kg $mol^{-1}$) of the water molecule, and $\alpha$ represents a thermal accommodation coefficient (–). For more details of the calculation methods of the diffusion coefficient and the thermal accommodation coefficient, please refer to documents (Cao, H. S., Vanapalli, S., Holland, H. J., Vermeer, C. H., ter Brake, H. J. M, 2013. Clogging in micromachined Joule-Thomson coolers: Mechanism and preventive measures. Applied Physics Letters 103, 034107; and Cao, H. S., Vanapalli, S., Holland, H. J., Vermeer, C. H., ter Brake, H. J. M, 2017. Numerical analysis of clogging dynamics in micromachined Joule-Thomson coolers. International Journal of Refrigeration 81, 60-68).

In step 2-2), heat flux required by sublimation of the ice is estimated in accordance with formula (2.1) based on the ice formation rate of the trace water and sublimation latent heat of the ice:

$$\dot{Q} = \dot{n}_{dep} \Delta H_{ice} \quad (2.1)$$

where $\dot{Q}$ represents the heat flux ($W \cdot m^{-2}$), and $\Delta H_{ice}$ represents the sublimation latent heat ($J \cdot mol^{-1}$) of the ice.

In step 2-3), the input power corresponding to the optimal wavelength determined by step 1) is estimated in accordance with formula (3) based on the estimated heat flux $\dot{Q}$ required by the sublimation of the ice, an area of a passage of a throttle in the cryocooler and a transmissivity of a material of the cryocooler to the electromagnetic wave:

$$W = \dot{Q}A/\tau \quad (3)$$

where W represents the input power (W), A represents the area ($m^2$) of the passage of the throttle in the cryocooler, and $\tau$ represents the transmissivity, which depends on the material of the cryocooler and its thickness as well as the wavelength of the electromagnetic wave.

In step 3), an electromagnetic wave with the power W is emitted by a laser capable of generating the optimal wavelength in a direction perpendicular to the passage of the throttle in the cryocooler to eliminate the ice in the passage of the throttle.

In some embodiments, in order to reduce the power of the electromagnetic wave and keep the mass flow rate of the cryocooler stable at a minimum electromagnetic power, the method of the present disclosure further includes:

monitoring a variation of mass flow rate in the cryocooler;

increasing, if the mass flow rate in the cryocooler is unstable, the power of the electromagnetic wave until the mass flow rate in the cryocooler is stable;

determining whether the estimated input power is minimum when the mass flow rate in the cryocooler tends to be stable, if no, decreasing the power of the electromagnetic wave until the mass flow rate in the cryocooler is kept stable at a minimum power so as to determine the minimum power $W_{min}$ of the electromagnetic wave corresponding to the optimal wavelength needed for eliminating the impurity (especially the ice) in the passage of the throttle in the cryocooler; and emitting an electromagnetic wave with the minimum power $W_{min}$ by the laser capable of generating the optimal wavelength in the direction perpendicular to the passage of the throttle in the cryocooler.

In some embodiments, the method of the present disclosure further includes:

continuously irradiating the passage of the throttle by the laser during a working process of the miniature Joule-Thomson cryocooler; or continuously irradiating the passage of the throttle by the laser when the flow rate in the miniature Joule-Thomson cryocooler is detected to be lower than a set value, and stopping irradiating the passage until the flow rate in the miniature Joule-Thomson cryocooler is higher than the set value.

The working principle of some embodiments of the present disclosure is as follows.

Figure 3:
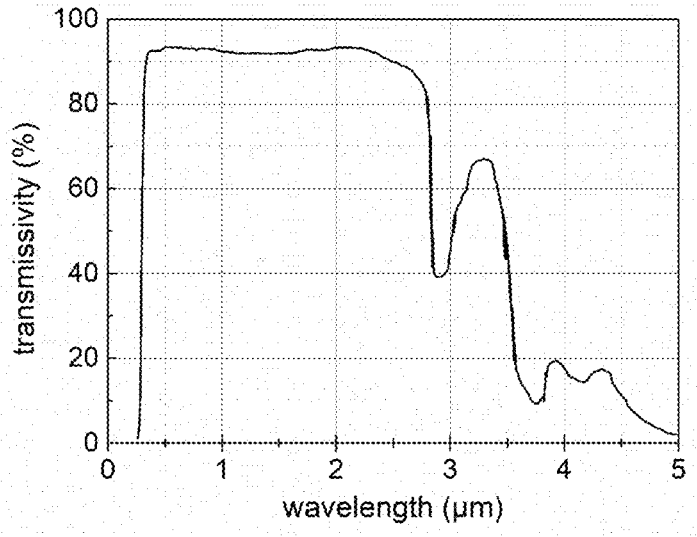
FIG. 3 shows the transmissivity of borosilicate glass in 1 mm thickness to electromagnetic waves with a wavelength ranging from 0.2 to 5 μm.

As illustrated in FIG. 2, 80 K crystalline ice and 80 K amorphous ice have absorption peaks at 3.06 μm and 3.04 μm, respectively, which are mainly due to the bending vibration, asymmetric stretching vibration and symmetric stretching vibration of hydroxyl (OH) in water molecules. Further, the wavelength range and absorptivity of electromagnetic waves absorbed by the ice are affected by the form and temperature of the ice. In practical application, the optimal wavelength of the electromagnetic wave can be selected based on the form and temperature of the ice, the optimal power of the electromagnetic wave can be selected based on the flow rate of the working medium and the concentration of trace water in the working medium, and the deicing effect can be fed back according to the flow rate of the cryocooler. FIG. 3 shows the transmissivity of borosilicate glass in 1 mm thickness to electromagnetic waves with different wavelengths. As the thickness of the miniature Joule-Thomson cryocooler based on borosilicate glass is also about 1 mm, the transmissivity of the electromagnetic wave with the optimal wavelength can be calculated with data from this graph. Embodiments of the present disclosure are not only applicable to the miniature Joule-Thomson cryocooler made of borosilicate glass, but also applicable to those made of other materials with good transmissivity to electromagnetic waves in the near/mid-infrared bands.

Embodiments of the present disclosure have the following advantages.

According to the method for suppressing the blockage of a miniature Joule-Thomson cryocooler proposed in the present disclosure, as the material (such as glass, silicon, etc.) of the miniature Joule-Thomson cryocooler has a larger transmissivity to specific electromagnetic waves in near/mid-infrared bands, while the ice has a larger absorptivity to such specific electromagnetic waves, the ice in the throttle can be selectively heated rather than heating the whole cold end of the miniature Joule-Thomson cryocooler, so as to remove the ice in the throttle while maintaining the continuous low-temperature operation of the miniature Joule-Thomson cryocooler. Due to the bending vibration, asymmetric stretching vibration and symmetric stretching vibration of the hydroxyl (OH) in water molecule, the wavelength range and absorptivity of electromagnetic waves absorbed by the ice are affected by the form and temperature of the ice. In practical applications, the optimal wavelength of the electromagnetic wave can be selected based on the form and temperature of the ice, the optimal power of the electromagnetic wave can be selected based on the flow rate of the working medium and the concentration of trace water in the working medium, and the deicing effect can be fed back according to the flow rate of the cryocooler. The method according to embodiments of the present disclosure is easy to implement and responds fast, and can meet the requirements for the long-term low-temperature operation of the miniature Joule-Thomson cryocooler in the fields like national defense and military, scientific research, electronic communications and biomedicine.

The present disclosure provides in embodiments a system for suppressing the blockage of a miniature Joule-Thomson cryocooler based on a photothermal effect. The system includes: a miniature Joule-Thomson cryocooler which includes a throttle; a vacuum chamber configured to accommodating the miniature Joule-Thomson cryocooler; and a laser, having an emitting end accommodated in the vacuum chamber and configured to emit, in a direction perpendicular to a passage of the throttle, an electromagnetic wave with an optimal wavelength and a minimum power determined by the method as described in embodiments hereinbefore to eliminate the impurity (especially ice) deposited in the passage of the throttle.

In some embodiments of the present disclosure, the miniature Joule-Thomson cryocooler further includes an upper substrate, a middle substrate and a lower substrate stacked in sequence, an inlet, a high-pressure passage, an evaporator, a low-pressure passage, and an outlet. A working medium enters into the high-pressure passage from the inlet and is expanded and cooled down through the throttle to form a low-temperature low-pressure working medium. The low-temperature low-pressure working medium flows through the evaporator and the low-pressure passage successively to precool a high-temperature high-pressure working medium from the high-pressure passage, and flows out of the cryocooler through the outlet.

In some embodiments of the present disclosure, the upper substrate, the middle substrate and the lower substrate are welded into an integrated structure.

The present disclosure provides in embodiments a device for suppressing the blockage of a miniature Joule-Thomson cryocooler based on a photothermal effect. The device includes: a processor; a memory having stored therein a computer program that, when executed by the processor, causes the processor to perform the method as described in embodiments hereinbefore.

The present disclosure provides in embodiments a non-transitory computer-readable storage medium having stored therein instructions that, when executed by a processor, causes the processor to perform the method as described in embodiments hereinbefore.

It should be noted that all of the above features and advantages described for the method are also applicable to the device and system, which will not be elaborated herein.

An application example of embodiments of the present disclosure is given below.

Figure 4:
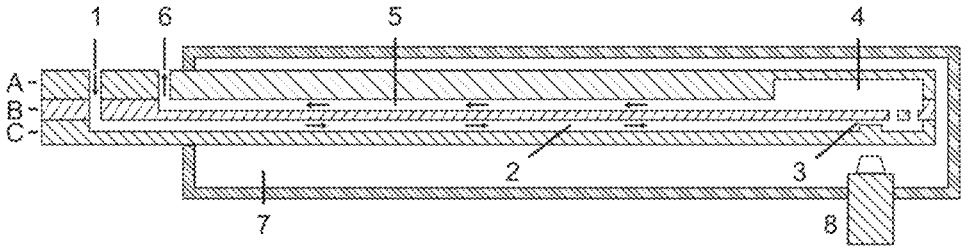
FIG. 4 is a schematic diagram of a system for suppressing the blockage of a miniature Joule-Thomson cryocooler based on a photothermal effect according to some embodiments of the present disclosure.

FIG. 4 is a schematic diagram of a system for suppressing the blockage of a miniature Joule-Thomson cryocooler based on a photothermal effect according to some embodiments of the present disclosure. Referring to FIG. 4, the miniature Joule-Thomson cryocooler includes an upper substrate A, a middle substrate B and a lower substrate C, which are stacked in sequence and welded into an integrated structure. Microchannel structures are processed in the three layers of substrates, together with which respective parts of the cryocoolers are formed. The working medium of the miniature Joule-Thomson cryocooler flows into a high-pressure passage 2 via an inlet 1, and then flows through the throttle 3 to expand and cool down. The low-temperature low-pressure working medium flows through an evaporator 4 and a low-pressure passage 5 of the cryocooler successively to precool the high-temperature high-pressure working medium from the high-pressure passage, and flows out of the cryocooler through an outlet 6. In order to reduce the heat loss of the cryocooler, the cryocooler is usually placed in a vacuum chamber 7. When the cryocooler runs steadily, a liquid working medium exists in the evaporator 4, and the refrigeration is realized by the evaporation of the liquid working medium. Under low temperature conditions, trace water in the working medium is condensed and deposited in the throttle 3, causing the blockage of the cryocooler. A near/mid-infrared laser 8 with its emitting end placed in the vacuum chamber 7 functions as a light source to emit electromagnetic waves in the near/mid-infrared band. Appropriate wavelength and power of the electromagnetic wave are selected according to the process shown in FIG. 1, and the electromagnetic wave is emitted to the position of the throttle 3. The electromagnetic wave penetrates the cryocooler, and is absorbed by the ice in the throttle 3 formed by the trace water on a low temperature surface. The ice sublimates under the induction of the photothermal effect, thereby suppressing the blockage of the miniature Joule-Thomson cryocooler and realizing the continuous low-temperature operation of the miniature Joule-Thomson cryocooler for a long-term.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples. In addition, in the absence of contradiction, those skilled in the art can combine the different embodiments or examples described in this specification, or combine the features of different embodiments or examples.

It should be noted that, in this context, relational terms such as first and second are used only to distinguish an entity from another entity or to distinguish an operation from another operation without necessarily requiring or implying that the entities or operations actually have a certain relationship or sequence. Moreover, "comprise", "include" or other variants are non-exclusive, thus a process, a method, an object or a device including a series of elements not only include such elements, but also include other elements which may not mentioned, or inherent elements of the process, method, object or device. If there is no further limitation, a feature defined by an expression of "include a . . . " does not mean the process, the method, the object or the device can only have one elements, same elements may also be included.

It should be noted that, although the present disclosure has been described with reference to the embodiments, it will be appreciated by those skilled in the art that the disclosure includes other examples that occur to those skilled in the art to execute the disclosure. Therefore, the present disclosure is not limited to the embodiments.

Any process or method described herein in other ways may be understood to include one or more modules, segments or portions of codes of executable instructions for achieving specific logical functions or steps in the process, and the scope of a preferred embodiment of the present disclosure includes other implementations, which may not follow a shown or discussed order according to the related functions in a substantially simultaneous manner or in a reverse order, to perform the function, which should be understood by those skilled in the art.

The logic and/or step described in other manners herein or shown in the flow chart, for example, a particular sequence table of executable instructions for realizing the logical function, may be specifically achieved in any computer readable medium to be used by the instruction execution system, device or equipment (such as the system based on computers, the system including processors or other systems capable of obtaining the instruction from the instruction execution system, device and equipment and executing the instruction), or to be used in combination with the instruction execution system, device and equipment. As to the specification, "the computer readable medium" may be any device adaptive for including, storing, communicating, propagating or transferring programs to be used by or in combination with the instruction execution system, device or equipment. More specific examples of the computer readable medium include but are not limited to: an electronic connection (an electronic device) with one or more wires, a portable computer enclosure (a magnetic device), a random access memory (RAM), a read only memory (ROM), an erasable programmable read-only memory (EPROM or a flash memory), an optical fiber device and a portable compact disk read-only memory (CDROM). In addition, the computer readable medium may even be a paper or other appropriate medium capable of printing programs thereon, this is because, for example, the paper or other appropriate medium may be optically scanned and then edited, decrypted or processed with other appropriate methods when necessary to obtain the programs in an electric manner, and then the programs may be stored in the computer memories.

It should be understood that each part of the present disclosure may be realized by the hardware, software, firmware or their combination. In the above embodiments, a plurality of steps or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

Those skilled in the art shall understand that all or parts of the steps in the above exemplifying method of the present disclosure may be achieved by commanding the related hardware with programs. The programs may be stored in a computer readable storage medium, and the programs include one or a combination of the steps in the method embodiments of the present disclosure when run on a computer.

In addition, each function cell of the embodiments of the present disclosure may be integrated in a processing module, or these cells may be separate physical existence, or two or more cells are integrated in a processing module. The integrated module may be realized in a form of hardware or in a form of software function modules. When the integrated module is realized in a form of software function module and is sold or used as a standalone product, the integrated module may be stored in a computer readable storage medium.

The storage medium mentioned above may be read-only memories, magnetic disks, CD, etc.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A method for suppressing a blockage of a miniature Joule-Thomson cryocooler based on a photothermal effect, comprising:

1) determining form and temperature of a trace impurity contained in a working medium of the cryocooler according to an operating condition of the cryocooler, and selecting an optimal wavelength of an electromagnetic wave based on the form and temperature of the impurity and a peak of absorption spectrum of the impurity to electromagnetic waves;

2) estimating, via a prediction model of input power of the electromagnetic wave, an initial value of input power corresponding to the optimal wavelength determined by step 1), which comprises:

2-1) estimating a deposition rate of the trace impurity contained in the working medium of the cryocooler in accordance with formula (1) based on pressure of the working medium in the cryocooler, a content of the trace impurity in the working medium and a cooling temperature of the cryocooler:

$$\dot{n}_{dep} = (p - p_{sat})\left(\frac{0.5hRT}{D_{12}} + \frac{\sqrt{2\pi MRT}}{\alpha}\right) \quad (1)$$

where $\dot{n}_{dep}$ represents a deposition rate, p represents average partial pressure of the trace impurity in the working medium, $p_{sat}$ represents saturated vapor pressure of impurity at the cooling temperature, h represents a height of a microchannel in the cryocooler, R represents an ideal gas constant, $D_{12}$ represents a diffusion coefficient of impurity molecules in the working medium, M represents a molar mass of the impurity molecule, and $\alpha$ represents a thermal accommodation coefficient;

2-2) estimating heat flux required by sublimation of the impurity in accordance with formula (2) based on the deposition rate of the trace impurity and sublimation latent heat of the impurity:

$$\dot{Q} = \dot{n}_{dep}\Delta H_{imp} \quad (2)$$

where $\dot{Q}$ represents the heat flux, and $\Delta H_{imp}$ represents the sublimation latent heat of the impurity; and 2-3) estimating the input power corresponding to the optimal wavelength determined by step 1) in accordance with formula (3) based on the estimated heat flux $\dot{Q}$ required by the sublimation of the impurity, an area of a passage of a throttle in the cryocooler and a transmissivity of a material of the cryocooler to the electromagnetic wave:

$$W=\dot{Q}A/\tau \tag{3}$$

where W represents the input power, A represents the area of the passage of the throttle in the cryocooler, and $\tau$ represents the transmissivity; and 3) emitting an electromagnetic wave with the power W by a laser capable of generating the optimal wavelength in a direction perpendicular to the passage of the throttle in the cryocooler to eliminate the impurity in the passage of the throttle.

2. The method according to claim 1, further comprising:

monitoring a variation of mass flow rate in the cryocooler;

increasing, if the mass flow rate in the cryocooler is unstable, the power of the electromagnetic wave until the mass flow rate in the cryocooler is stable;

determining whether the estimated input power is minimum, if no, decreasing the power of the electromagnetic wave until the mass flow rate in the cryocooler is kept stable at a minimum power so as to determine the minimum power $W_{min}$ of the electromagnetic wave with the optimal wavelength needed for eliminating the impurity in the passage of the throttle in the cryocooler; and emitting an electromagnetic wave with the minimum power $W_{min}$ by the laser capable of generating the optimal wavelength in the direction perpendicular to the passage of the throttle in the cryocooler.

3. The method according to claim 2, further comprising:

continuously irradiating the passage of the throttle by the laser during a working process of the miniature Joule-Thomson cryocooler; or continuously irradiating the passage of the throttle by the laser when the flow rate in the miniature Joule-Thomson cryocooler is detected to be lower than a set value, and stopping illuminating the passage until the flow rate in the miniature Joule-Thomson cryocooler is higher than the set value.

4. The method according to claim 1, further comprising:

continuously irradiating the passage of the throttle by the laser during a working process of the miniature Joule-Thomson cryocooler; or continuously irradiating the passage of the throttle by the laser when the flow rate in the miniature Joule-Thomson cryocooler is detected to be lower than a set value, and stopping irradiating the passage until the flow rate in the miniature Joule-Thomson cryocooler is higher than the set value.

5. The method according to claim 1, wherein the trace impurity contained in the working medium of the cryocooler is trace water contained in the working medium, and the method comprises:

1) determining form and temperature of ice according to an operating condition of the miniature Joule-Thomson cryocooler, and selecting an optimal wavelength of an electromagnetic wave based on the form and temperature of the ice and a peak of absorption spectrum of the ice to electromagnetic waves;

2) estimating, via a prediction model of input power of the electromagnetic wave, an initial value of input power corresponding to the optimal wavelength determined by step 1), which comprises:

2-1) estimating an ice formation rate of trace water contained in a working medium of the cryocooler in accordance with formula (1) based on pressure of the working medium in the cryocooler, a content of the trace water in the working medium and a cooling temperature of the cryocooler:

$$\dot{n}_{dep} = (p - p_{sat})/\left(\frac{0.5hRT}{D_{12}} + \frac{\sqrt{2\pi MRT}}{\alpha}\right) \tag{1}$$

where $\dot{n}_{dep}$ represents a deposition rate, p represents average partial pressure of the trace water in the working medium, $p_{sat}$ represents saturated vapor pressure of steam at the cooling temperature, h represents a height of a microchannel in the cryocooler, R represents an ideal gas constant, $D_{12}$ represents a diffusion coefficient of water molecules in the working medium, M represents a molar mass of the water molecule, and $\alpha$ represents a thermal accommodation coefficient;

2-2) estimating heat flux required by sublimation of the ice in accordance with formula (2.1) based on the ice formation rate of the trace water and sublimation latent heat of the ice:

$$\dot{Q}=\dot{n}_{dep}\Delta H_{ice} \tag{2.1}$$

where $\dot{Q}$ represents the heat flux, and $\Delta H_{ice}$ represents the sublimation latent heat of the ice; and 2-3) estimating the input power corresponding to the optimal wavelength determined by step 1) in accordance with formula (3) based on the estimated heat flux $\dot{Q}$ required by the sublimation of the ice, an area of a passage of a throttle in the cryocooler and a transmissivity of a material of the cryocooler to the electromagnetic wave:

$$W=\dot{Q}A/\tau \tag{3}$$

where W represents the input power, A represents the area of the passage of the throttle in the cryocooler, and $\tau$ represents the transmissivity; and 3) emitting an electromagnetic wave with the power W by a laser capable of generating the optimal wavelength in a direction perpendicular to the passage of the throttle in the cryocooler to eliminate the ice in the passage of the throttle.

6. A system for suppressing a blockage of a miniature Joule-Thomson cryocooler based on a photothermal effect, comprising:

the miniature Joule-Thomson cryocooler which comprises a throttle;

a vacuum chamber configured to accommodating the miniature Joule-Thomson cryocooler; and a laser, having an emitting end accommodated in the vacuum chamber and configured to emit, in a direction perpendicular to a passage of the throttle, an electromagnetic wave with an optimal wavelength and a minimum power determined by the method according to claim 1 to eliminate trace impurity deposited in the passage of the throttle.

7. The system according to claim 6, wherein the miniature Joule-Thomson cryocooler further comprises an upper substrate, a middle substrate and a lower substrate stacked in sequence, an inlet, a high-pressure passage, an evaporator, a low-pressure passage, and an outlet, wherein a working medium enters into the high-pressure passage from the inlet and is expanded and cooled down through the throttle to form a low-temperature low-pressure working medium;

the low-temperature low-pressure working medium flows through the evaporator and the low-pressure passage successively to precool a high-temperature high-pressure working medium from the high-pressure passage, and flows out of the cryocooler through the outlet.

8. The system according to claim 6, wherein the miniature Joule-Thomson cryocooler further comprises an upper substrate, a middle substrate and a lower substrate welded into an integrated structure.

9. A device for suppressing the blockage of a miniature Joule-Thomson cryocooler based on a photothermal effect, comprising:

a processor;

a memory having stored therein a computer program that, when executed by the processor, causes the processor to perform the method according to claim 1.

* * * * *